US010465971B1

(12) United States Patent
El Sayed et al.

(10) Patent No.: US 10,465,971 B1
(45) Date of Patent: Nov. 5, 2019

(54) SLIDING STORAGE BIN

(71) Applicant: WHIRLPOOL CORPORATION, Benton Harbor, MI (US)

(72) Inventors: Kamil El Sayed, Wroclaw (PL); Alberto Galizia, Milan (IT); Marek Gorzelanczyk, Bierzow (PL); Wojciech Klupa, Wroclaw (PL); Krzysztof Krawczyk, Kielczow (PL); Maurizio Valle, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/050,014

(22) Filed: Jul. 31, 2018

(51) Int. Cl.
*A47B 96/04* (2006.01)
*F25D 23/04* (2006.01)
*F25D 25/00* (2006.01)

(52) U.S. Cl.
CPC ..... *F25D 23/04* (2013.01); *F25D 25/005* (2013.01)

(58) Field of Classification Search
CPC ..... F25D 23/04
USPC ..... 312/405.1
See application file for complete search history.

(56) References Cited

U.S. PATENT DOCUMENTS 3,886,698 A * 6/1975 Raith ..... A47B 57/404 211/126.16
4,829,653 A * 5/1989 Stich ..... F25D 23/04 29/458
4,921,315 A * 5/1990 Metcalfe ..... A47B 96/16 312/321.5
6,582,038 B2 6/2003 Moreno-Olguin et al.
6,742,855 B2 * 6/2004 Whitaker ..... F25D 23/04 312/321.5
6,908,163 B1 * 6/2005 Hebeler ..... F25D 23/04 312/321.5
7,472,974 B2 * 1/2009 Czach ..... F25D 23/04 312/321.5
7,748,805 B2 7/2010 Lucas et al.
8,052,236 B2 11/2011 Kim
8,123,314 B2 2/2012 Becke
8,322,804 B2 12/2012 Kim
8,701,374 B2 4/2014 Becke et al.
9,103,581 B2 * 8/2015 Babinski ..... F25D 23/04
9,389,012 B2 * 7/2016 Rackley ..... F25D 23/04
9,518,776 B2 12/2016 Baldo
9,784,494 B2 * 10/2017 Chow ..... F25D 23/04
9,903,640 B2 2/2018 Curtis
2003/0020386 A1 * 1/2003 Leimkuehler ..... F25D 23/04 312/405.1
2007/0267952 A1 * 11/2007 Koo ..... F25D 23/04 312/405.1
2014/0062283 A1 3/2014 Baldo

FOREIGN PATENT DOCUMENTS

GB 2176885 A 1/1987

* cited by examiner

*Primary Examiner* — Matthew W Ing
(74) *Attorney, Agent, or Firm* — Price Heneveld LLP

(57) ABSTRACT

A refrigerated appliance includes a guide track mounted on a door of the refrigerated appliance. A mounting plate slidably engages with the guide track. The mounting plate is equipped with tabs. The mounting plate is actuatable along the guide track. A storage bin is equipped with receivers that removably engage with the tabs on the mounting plate. The storage bin moves with the mounting plate when the mounting plate is actuated along the guide track.

20 Claims, 4 Drawing Sheets

SLIDING STORAGE BIN

FIELD OF THE DISCLOSURE

The present disclosure generally relates to a refrigerated appliance. More specifically, the present disclosure relates to a refrigerate appliance having a sliding storage bin.

BACKGROUND

Refrigerated appliances are often provided with a variety of storage solutions. However, many of the available storage solutions are capable of only one configuration. Accordingly, additional solutions are needed that offer users greater flexibility for customization.

SUMMARY

According to a first aspect of the present disclosure, a refrigerated appliance includes a guide track mounted on a door of the refrigerated appliance and extending in a vertical direction. A mounting plate slidably engages with the guide track. The mounting plate is equipped with tabs that extend rearward from a front face toward an interior surface of the door. The mounting plate is vertically actuatable along the guide track. A storage bin is equipped with receivers that are configured to engage and disengage with the tabs on the mounting plate such that the storage bin is removably coupled to the refrigerated appliance.

According to a second aspect of the present disclosure, a refrigerated appliance includes a guide track mounted on a door of the refrigerated appliance and extending in a vertical direction. A mounting plate slidably engages with the guide track. The mounting plate is equipped with tabs. The mounting plate is vertically actuatable along the guide track. A storage bin is equipped with receivers that are configured to engage and disengage with the tabs on the mounting plate such that the storage bin is removably coupled to the refrigerated appliance.

According to a third aspect of the present disclosure, a refrigerated appliance includes a guide track mounted on a door of the refrigerated appliance. A mounting plate slidably engages with the guide track. The mounting plate is equipped with tabs. The mounting plate is actuatable along the guide track. A storage bin is equipped with receivers that are configured to engage and disengage with the tabs on the mounting plate such that the storage bin is removably coupled to the refrigerated appliance.

These and other aspects, objects, and features of the present disclosure will be understood and appreciated by those skilled in the art upon studying the following specification, claims, and appended drawings.

DETAILED DESCRIPTION

Figure 1:
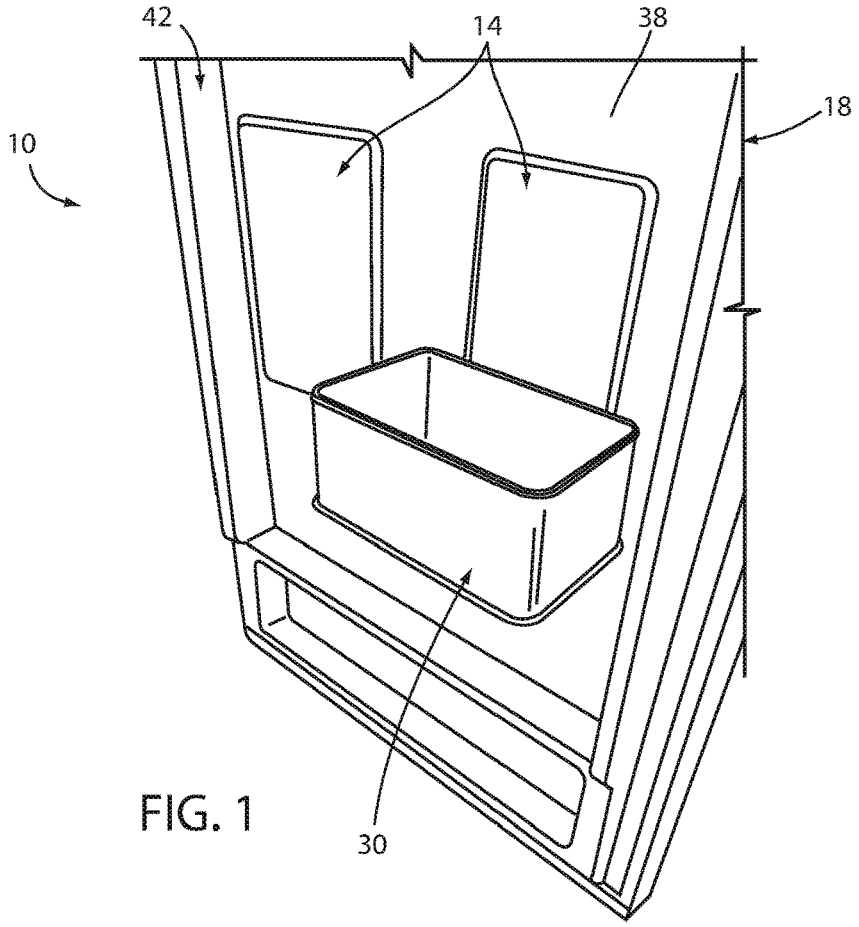
FIG. 1 is a front perspective view of a storage bin mounted to a refrigerated appliance, according to one example.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a sliding storage bin. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-6, a refrigerated appliance 10 includes a guide track 14 that is mounted in a cavity 18 of the refrigerated appliance 10. A mounting plate 22 slidably engages with the guide track 14. In some examples, the mounting plate 22 may also removably engage with the guide track 14. The mounting plate 22 is equipped with tabs 26. The mounting plate 22 is actuatable along the guide track 14. For example, the mounting plate 22 can be actuated in a vertical direction when the guide track 14 is vertically disposed within the cavity 18 of the refrigerated appliance 10. A storage bin 30 is equipped with receivers 34 that removably engage with the tabs 26 on the mounting plate 22 such that the storage bin 30 is removably coupled to the refrigerated appliance 10. In various examples, the storage bin 30 can move with the mounting plate 22 when the mounting plate 22 is actuated along the guide track 14.

Referring again to FIG. 1, the guide track 14 can be fixedly coupled to an interior surface 38 of the cavity 18. For example, the guide track 14 can be mounted to a door 42 of the refrigerated appliance 10. The refrigerated appliance 10 can be equipped with one or more of the guide tracks 14 such that a user is able to customize a configuration of the cavity 18 for their particular needs or preferences at a given time. In the present disclosure, the storage bin 30 can be mounted to the guide track 14 by the mounting plate 22 such that the storage bin 30 is configured for use within the refrigerated appliance 10. Additionally, the storage bin 30 can be utilized at locations that are external to the refrigerated appliance 10 by removing the storage bin 30 from the mounting plate 22 or by actuating the storage bin 30 and the mounting plate 22 along the guide track 14 until the storage bin 30 and the mounting plate 22 are no longer mounted to the guide track 14.

Figure 2:
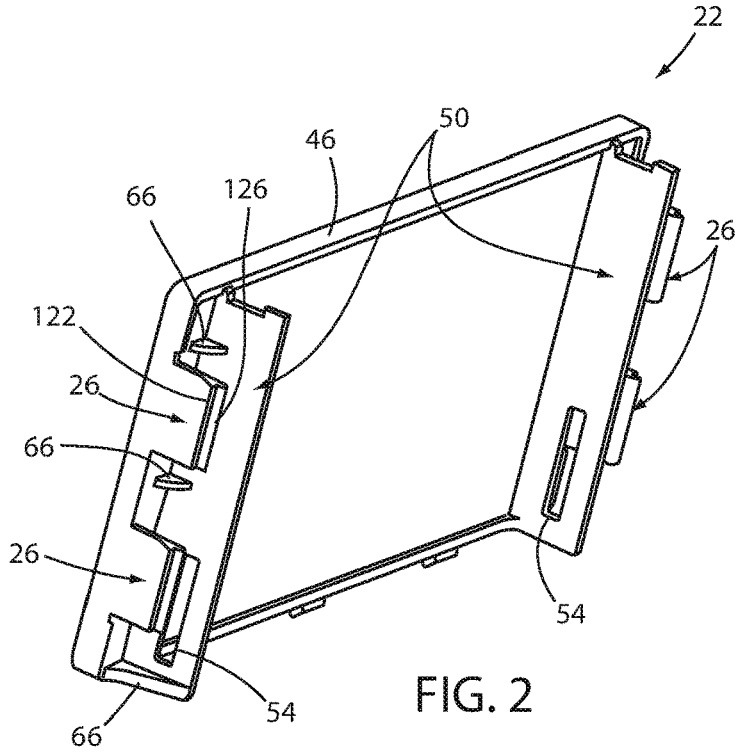
FIG. 2 is a rear perspective view of a mounting plate, according to one example.

Referring now to FIG. 2, a rear side of the mounting plate 22 is shown with a bottom edge 46 facing upward such that the mounting plate 22 is in an upside down orientation. The mounting plate 22 is equipped with track engagement portions 50 that are positioned radially inward from the tabs 26. The tabs 26, in one example, can be quick-connect tabs. The track engagement portions 50 define one or more track apertures 54. The track apertures 54 can be utilized to couple the mounting plate 22 directly to the guide track 14. Alternatively, the track apertures 54 can be utilized to couple the mounting plate 22 to the guide track 14 indirectly. For example, the track apertures 54 can engage with a track bracket 58 (see FIGS. 5 and 6) that couples to a mounting lip 62 (see FIG. 5) of the guide track 14. Alternatively, the track apertures 54 can engage directly with the mounting lip 62 of the guide track 14. In either arrangement, the track apertures 54 can be utilized to retain the mounting plate 22 to the guide track 14. A substantial portion of the track engagement portions 50 of the mounting plate 22 directly contact the guide track 14 when the mounting lip 62 is coupled to the track apertures 54, regardless of whether the track bracket 58 is employed. Plate reinforcement structures 66 are provided between the track engagement portions 50 and a body of the mounting plate 22 to provide a degree of rigidity to the track engagement portions 50 such that the mounting plate 22 is provided with greater lateral retention as well as enabling the storage bin 30 to support greater weights and be more securely anchored to the refrigerated appliance 10.

Figure 3:
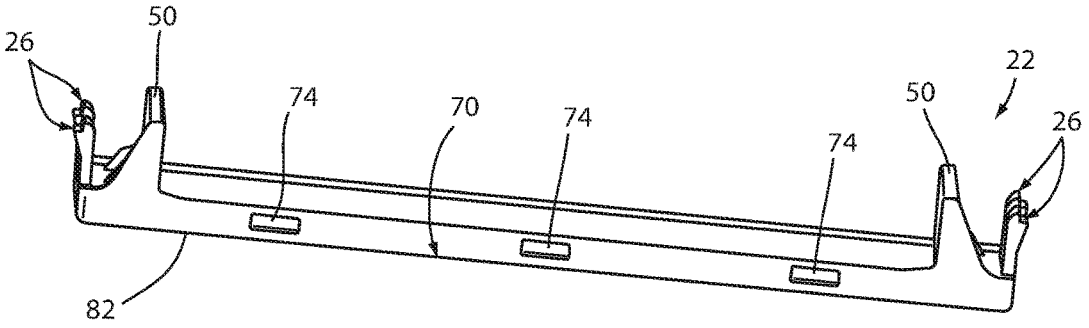
FIG. 3 is a top view of the mounting plate illustrating various features of the mounting plate, according to one example.
Figure 4:
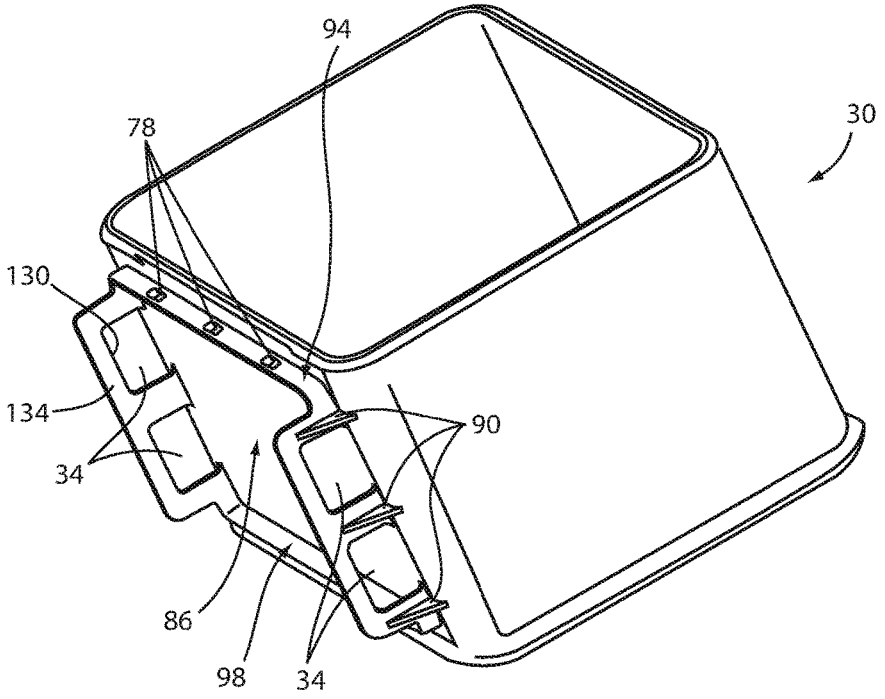
FIG. 4 is a side perspective view of the storage bin illustrating receivers, according to one example.

Referring to FIGS. 3 and 4, a top edge 70 of the mounting plate 22 is equipped with a plurality of retention structures 74 that protrude away from the top edge 70. The retention structures 74 are sized and positioned to engage with corresponding retention slots 78 on the storage bin 30. A front face 82 of the mounting plate 22 is substantially flat such that a substantially continuous surface is presented to a rear side 86 of the storage bin 30. Providing the retention structures 74 on the top edge 70 increases a loading capacity or maximum weight of items that can be stored within the storage bin 30. Additionally, the retention structures 74 provide lateral retention or resistance to movement of the storage bin 30 relative to the mounting plate 22. The lateral retention forces provided by the retention structures 74 may be particularly beneficial in examples where the storage bin 30 is mounted to the door 42 of the refrigerated appliance 10 since the door 42 of the refrigerated appliance 10 experiences rapid acceleration when the door is opened and closed. The lateral retention forces provided by the retention structures 74 are also beneficial in examples where the storage bin 30 is mounted to the refrigerated appliance 10 at locations that are not on the door 42 of the refrigerated appliance 10. The lateral retention forces provided by the retention structures 74 are beneficial when the storage bin 30 is mounted at locations other than on the door 42 of the refrigerated appliance 10 because items are often being added and removed from the refrigerated appliance 10 and there is a tendency for a user to contact or impact other items or components (e.g., the storage bin 30) when adding or removing items from the refrigerated appliance 10.

Referring again to FIGS. 3 and 4, lateral retention forces are also provided by bin reinforcement structures 90 that are coupled to the rear side 86 of the storage bin 30 and an exterior side of the receivers 34. The receivers 34, in one example, can be quick-connect receivers. The lateral retention forces provided by the plate reinforcement structures 66 and the bin reinforcement structures 90 are directionally the same for respective sides of the mounting plate 22 and the storage bin 30. Said another way, the plate reinforcement structures 66 are positioned on the mounting plate 22 such that the track engagement portions 50 are disposed between the plate reinforcement structures 66 and the guide track 14. Similarly, the bin reinforcement structures 90 are positioned on the storage bin 30 such that the receivers 34 are disposed between the bin reinforcement structures 90 and the guide track 14. Accordingly, the mounting plate 22 and the storage bin 30 are both configured to resist unintentional deformation that can result in a decoupling of at least one of the mounting plate 22 and the storage bin 30 from the guide track 14. The retention slots 78 on the storage bin 30 are positioned on an upper cross member 94. The upper cross member 94 extends between the receivers 34. The upper cross member 94 is coupled to the receivers 34 and the rear side 86 of the storage bin 30. A lower cross member 98 similarly extends between the receivers 34. The lower cross member 98 is also coupled to the receivers 34 and the rear side 86 of the storage bin 30. The upper and lower cross members 94, 98 provide additional support and rigidity to the receivers 34 and the retention slots 78.

Figure 5:
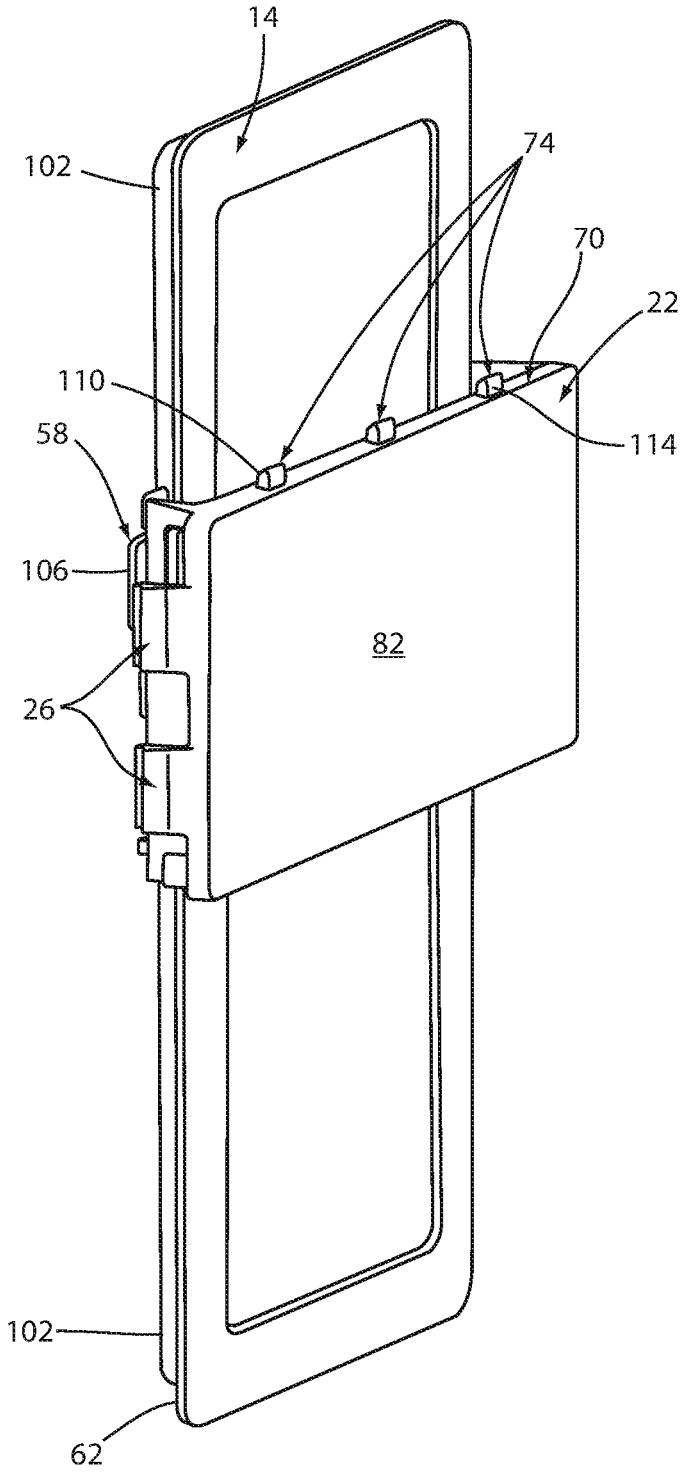
FIG. 5 is a front perspective view of the mounting plate and a track bracket mounted to a guide track, according to one example.

Referring now to FIG. 5, the guide track 14 is shown with the mounting plate 22 coupled thereto. The guide track 14 is provided with the mounting lip 62 that extends radially beyond a mounting base 102 in horizontal and vertical directions such that a space is created between a rearward side of the mounting lip 62 and a surface to which the guide track 14 is coupled. The track bracket 58 can be utilized to couple the mounting plate 22 to the guide track 14. The track bracket 58 can operate in a number of ways according to various examples of the present disclosure. For example, the track bracket 58 can couple directly to the mounting lip 62 and be actuated along the guide track 14 by way of an interference between the rearward side of the mounting lip 62 and the interior surface 38 to which the guide track 14 is coupled. Alternatively, or additionally, the track bracket 58 may couple directly to the mounting lip 62 by a compression or pinch fit of an actuatable lever. In either example, a rearward protrusion 106 can extend from the track bracket 58 that can provide the interference fit between the mounting lip 62 and the interior surface 38 that the guide track 14 is coupled to and/or can provide at least a portion of the actuatable lever that engages with the guide track 14 in a movable fashion.

Referring again to FIG. 5, the retention structures 74 are positioned along the top edge 70 of the mounting plate 22. The retention structures 74 are provided with an angled top surface 110 that slopes in a downward direction as a distance from the front face 82 of the mounting plate 22 increases. The downward sloping of the angled top surface 110 is beneficial for the coupling and decoupling of the storage bin 30 relative to the mounting plate 22. A front side 114 of the retention structures 74 can be arcuate in profile such that as a distance above the top edge 70 is increased, a distance from the front face 82 of the mounting plate 22 is also increased for the front side of the retention structures 74. As with the downward sloping of the angled top surface 110, the arcuate profile of the front side 114 of the retention structures 74 is beneficial for the coupling and decoupling of the storage bin 30 relative to the mounting plate 22.

Referring further to FIG. 5, coupling of the storage bin 30 to the mounting plate 22 is accomplished by angling the retention slots 78 toward the retention structures 74 such that a distance between the retention slots 78 and the front face 82 of the mounting plate 22 is less than a distance between the lower cross member 98 and the front face 82 of the mounting plate 22. Then, the retention slots 78 are lowered over the retention structures 74 and the storage bin 30 is rotated such that the distance between the lower cross member 98 and the front face 82 of the mounting plate 22 is decreased until the receivers 34 engage with the tabs 26. To decouple or remove the storage bin 30 from the mounting plate 22, the process is generally reversed. To remove the storage bin 30, the tabs 26 are first disengaged from the receivers 34. Then, the distance between the lower cross member 98 and the front face 82 of the mounting plate 22 is increased and the retention slots 78 are disengaged with the retention structures 74. The angled top surface 110 and the arcuate profile of the front side 114 of the retention structures 74 facilitates the coupling and decoupling of the storage bin 30 relative to the mounting plate 22. Specifically, as the storage bin 30 is rotated, during either coupling or decoupling, the clearance provided by the angled top surface 110 and the arcuate profile of the front side 114 decreases a difficulty of coupling and decoupling while maintaining substantial retention forces when the storage bin 30 is coupled to the mounting plate 22. Accordingly, binding or sticking of the storage bin 30 relative to the mounting plate 22 is decreased or eliminated and a user has an easier time coupling and decoupling the storage bin 30 to the mounting plate 22. As the present disclosure provides the storage bin 30 as capable and configured to be utilized either within the refrigerated appliance 10 or external to the refrigerated appliance 10, the user may be actuating the storage bin 30 between the coupled and decoupled positions regularly. Therefore, it is important and beneficial that an ease of use for the user is prioritized.

Figure 6:
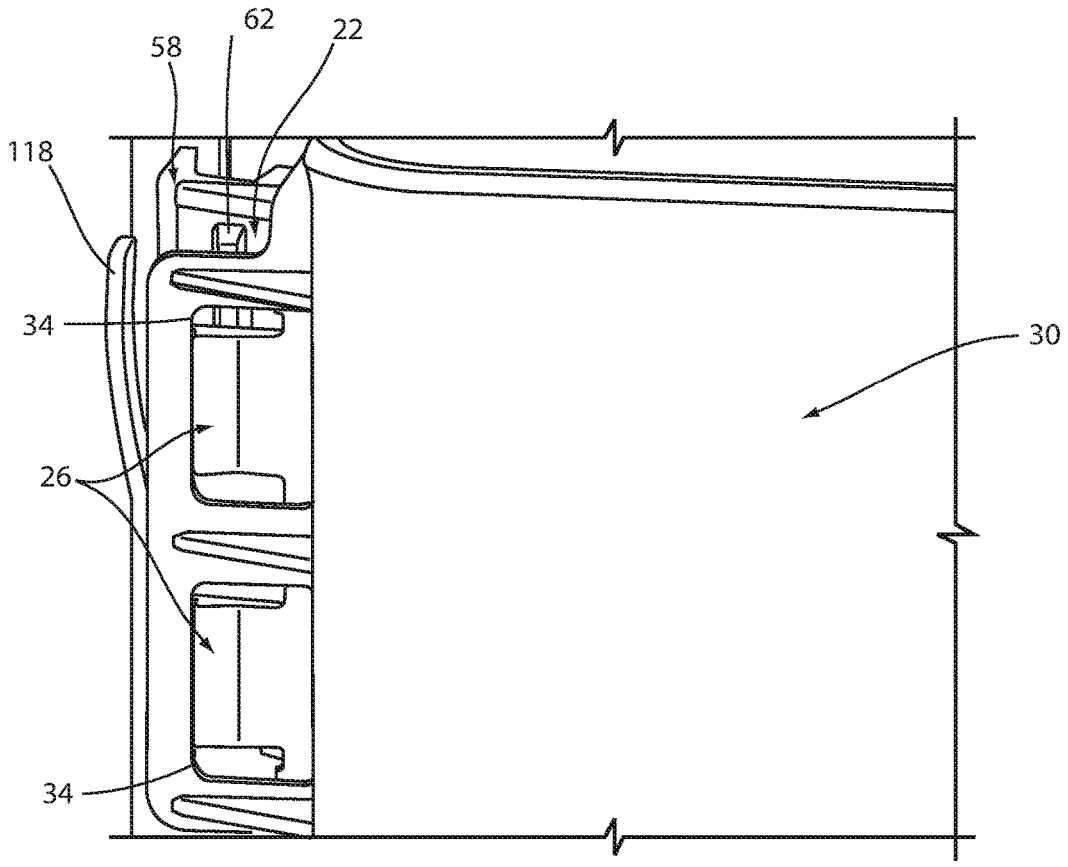
FIG. 6 is a side view of the storage bin illustrating an engagement between the receivers on the storage bin and tabs on the mounting plate, according to one example.

Referring to FIG. 6, the track bracket 58 engages with the mounting lip 62 and the mounting plate 22. A lever 118 can be coupled to at least one of the mounting plate 22 and the track bracket 58. As described above, the lever 118 can be utilized as an interference fit between the mounting lip 62 and the interior surface 38 that the guide track 14 is coupled to, or the lever 118 can be utilized as an actuatable lever 118 that enables a compression or pinch fit to the mounting lip 62. The receivers 34 engage with the tabs 26 in a removable fashion. Once the receivers 34 have been actuated over the tabs 26 and past a ledge 122 (see FIG. 2), then the tabs 26 snap into the receivers 34 to retain the storage bin 30. The tabs 26 can also include an extended portion 126 (see FIG. 2) that extends rearward and laterally offset from the ledge 122. The extended portion 126 engages with an inner surface 130 (see FIG. 4) of the receivers 34 while the ledge 122 engages with an aperture surface 134 (see FIG. 4) of the receivers 34. To disengage the receivers 34 from the tabs 26, the tabs 26 are actuated radially inward (e.g., about a living hinge) such that the ledge 122 clears the aperture surface 134 of the receivers 34. Additionally or alternatively, the receivers 34 can be actuated radially outward to clear the ledge 122 from the aperture surface 134. In general, the tabs 26 extend rearward from the front face 82 of the mounting plate 22 toward the interior surface of the cavity 18. In some examples, the track engagement portions 50 and/or the track bracket 58 of the mounting plate 22 engage with the interior surface of the cavity 18 to provide additional support to the mounting plate 22. While the storage bin 30 can be actuated along the guide track 14 in the present disclosure, the storage bin 30 remains fixed relative to the mounting plate 22. Said another way, a vertical position of the mounting plate 22 is substantially constant to a vertical position of the storage bin 30 throughout actuation of the mounting plate 22 and the storage bin 30 along the guide track 14.

According to various aspects of the present disclosure, the storage bin 30 can remain fixed relative to the mounting plate 22. The storage bin 30 can move with the mounting plate 22 when the mounting plate 22 is actuated along the guide track 14. The storage bin 30 can be configured for use within the refrigerated appliance 10 and external to the refrigerated appliance 10. The refrigerated appliance 10 can include the track bracket 58 that couples to the mounting lip 62 of the guide track 14. The track bracket 58 can engage with the track aperture 54 on the mounting plate 22 such that the mounting plate 22 is retained to the guide track 14. The mounting plate 22 includes the track engagement portions 50 positioned radially inward from the tabs 26. The track aperture 54 can be defined by the track engagement portions 50. The track engagement portions 50 of the mounting plate 22 can directly contact the guide track 14 when the mounting lip 62 is coupled to the track aperture 54. The track engagement portions 50 of the mounting plate 22 can engage with the interior surface 38 of the cavity 18 to provide support to the mounting plate 22. The tabs 26 can extend rearward from the front face 82 toward the interior surface 38 of the cavity 18.

Modifications of the disclosure will occur to those skilled in the art and to those who make or use the concepts disclosed herein. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described concepts, and other components, is not limited to any specific material. Other exemplary embodiments of the concepts disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise.

What is claimed is:

1. A refrigerated appliance, comprising:

a guide track mounted on a door of the refrigerated appliance and extending in a vertical direction, the guide track comprising a mounting lip;

a mounting plate that slidably engages with the guide track, wherein the mounting plate is equipped with tabs that extend rearward from a front face toward an interior surface of the door, wherein the mounting plate is vertically actuatable along the guide track;

a track bracket that couples to the mounting lip of the guide track, wherein the track bracket engages with a track aperture on the mounting plate such that the mounting plate is retained to the guide track; and a storage bin equipped with receivers configured to engage and disengage with the tabs on the mounting plate such that the storage bin is removably coupled to the refrigerated appliance.

2. The refrigerated appliance of claim 1, wherein the storage bin moves with the mounting plate when the mounting plate is actuated along the guide track.

3. The refrigerated appliance of claim 1, wherein the storage bin is configured for use within the refrigerated appliance and external to the refrigerated appliance.

4. The refrigerated appliance of claim 1, wherein the mounting lip extend radially beyond a mounting base in at least one of a horizontal direction and the vertical direction such that a space exists between a rearward side of the mounting lip and a surface to which the guide track is mounted.

5. The refrigerated appliance of claim 1, wherein the mounting plate comprises track engagement portions that are positioned radially inward from the tabs, and wherein the track aperture is defined by the track engagement portions.

6. The refrigerated appliance of claim 5, wherein the track engagement portions of the mounting plate directly contact the guide track when the mounting lip is coupled to the track aperture.

7. The refrigerated appliance of claim 6, wherein the track engagement portions of the mounting plate engage with the interior surface of the door to provide support to the mounting plate.

8. A refrigerated appliance, comprising:

a guide track mounted on a door of the refrigerated appliance and extending in a vertical direction, the guide track comprising a mounting lip;

a mounting plate that slidably engages with the guide track, wherein the mounting plate is equipped with tabs, wherein the mounting plate is vertically actuatable along the guide track;

a track bracket that couples to the mounting lip of the guide track, wherein the track bracket engages with a track aperture on the mounting plate such that the mounting plate is retained to the guide track; and a storage bin equipped with receivers configured to engage and disengage with the tabs on the mounting plate such that the storage bin is removably coupled to the refrigerated appliance.

9. The refrigerated appliance of claim 8, wherein the tabs extend rearward from a front face toward an interior surface of the door.

10. The refrigerated appliance of claim 8, wherein the storage bin moves with the mounting plate when the mounting plate is actuated along the guide track.

11. The refrigerated appliance of claim 8, wherein the mounting lip extends radially beyond a mounting base in at least one of a horizontal direction and the vertical direction such that a space exists between a rearward side of the mounting lip and a surface to which the guide track is mounted.

12. The refrigerated appliance of claim 8, wherein the mounting plate comprises track engagement portions that are positioned radially inward from the tabs, and wherein the track aperture is defined by the track engagement portions.

13. The refrigerated appliance of claim 12, wherein the track engagement portions of the mounting plate directly contact the guide track when the mounting lip is coupled to the track aperture.

14. The refrigerated appliance of claim 13, wherein the track engagement portions of the mounting plate engage with an interior surface of the door to provide support to the mounting plate.

15. A refrigerated appliance, comprising:

a guide track mounted on a door of the refrigerated appliance, the guide track comprising a mounting lip;

a mounting plate that slidably engages with the guide track, wherein the mounting plate is equipped with tabs, wherein the mounting plate is actuatable along the guide track;

a track bracket that couples to the mounting lip of the guide track, wherein the track bracket engages with a track aperture on the mounting plate such that the mounting plate is retained to the guide track; and a storage bin equipped with receivers configured to engage and disengage with the tabs on the mounting plate such that the storage bin is removably coupled to the refrigerated appliance.

16. The refrigerated appliance of claim 15, wherein the storage bin moves with the mounting plate when the mounting plate is actuated along the guide track.

17. The refrigerated appliance of claim 15, wherein the mounting lip extends radially beyond a mounting base in at least one of a horizontal direction and the vertical direction such that a space exists between a rearward side of the mounting lip and a surface to which the guide track is mounted.

18. The refrigerated appliance of claim 15, wherein the mounting plate comprises track engagement portions that are positioned radially inward from the tabs, and wherein the track aperture is defined by the track engagement portions.

19. The refrigerated appliance of claim 18, wherein the track engagement portions of the mounting plate directly contact the guide track when the mounting lip is coupled to the track aperture.

20. The refrigerated appliance of claim 19, wherein the track engagement portions of the mounting plate engage with an interior surface of the door to provide support to the mounting plate.

* * * * *